United States Patent [19]

Matsukura et al.

[11] 4,306,172

[45] Dec. 15, 1981

[54] SHADOW MASK OF BRAUN TUBE FOR COLOR TV AND PROCESS FOR MANUFACTURING THE SAME

[75] Inventors: Takashi Matsukura, Funahashi; Norio Tsukiji, Hiroshima; Yoshiaki Ishimoto, Kure; Masahiro Shimose, Amagasaki; Yasuo Imamura, Urawa, all of Japan

[73] Assignees: Nisshin Steel Co., Ltd.; Dai Nippon Printing, both of Tokyo, Japan

[21] Appl. No.: 92,748

[22] Filed: Nov. 9, 1979

[30] Foreign Application Priority Data

Nov. 15, 1978 [JP] Japan ..... 53-139845

[51] Int. Cl.[3] ..... H01J 29/80

[52] U.S. Cl. ..... 313/402; 29/163.5 R; 29/557; 29/25.18; 156/644; 252/502

[58] Field of Search ..... 313/402; 29/163.5 R, 29/557, 558, 25.18; 156/644; 252/502

[56] References Cited

U.S. PATENT DOCUMENTS

| | | | |
|---|---|---|---|
| 3,654,505 | 4/1972 | Davis et al. | 313/402 |
| 3,909,928 | 10/1978 | Sato et al. | 313/402 X |
| 4,210,843 | 7/1980 | Avadani | 313/402 X |

FOREIGN PATENT DOCUMENTS

| | | | |
|---|---|---|---|
| 2350366 | 4/1975 | Fed. Rep. of Germany | 313/402 |

*Primary Examiner*—Stanley T. Krawczewicz
*Attorney, Agent, or Firm*—Kane, Dalsimer, Kane, Sullivan and Kurucz

[57] ABSTRACT

A shadow mask of a Braun tube for a color TV made of a steel alloy having the following compositions in weight percent: $C \leqq 0.12$, $0.2 \leqq Mn \leqq 1.5$, $0.3 \leqq Si \leqq 1.5$, $1.0 \leqq 2Si + Mn$, $0.005 \leqq Al \leqq 0.030$, and the balance being Fe and unavoidable impurities. A cold rolled and annealed strip made from such a steel alloy has a Vickers hardness of at least 110 so that it can be easily and satisfactorily processed in the subsequent hole-formation step.

7 Claims, 1 Drawing Figure

SHADOW MASK OF BRAUN TUBE FOR COLOR TV AND PROCESS FOR MANUFACTURING THE SAME

BACKGROUND OF THE INVENTION

The present invention relates to a shadow mask of a Braun tube for a color TV and to a process for the manufacture thereof.

As is well known a shadow mask is an extremely thin metal strip having a great number of small holes, which is to be mounted in advance of the fluorescent surface of a Braun tube for a color TV, and performs an important part in that three electron beams emitted from three electron guns in accordance with signals of the three primary colors are allowed to pass through each hole so that fluorescent dots distributed on the fluorescent surface are caused to luminesce in separate three colors. Such a shadow mask has heretofore been manufactured as follows. A steel maker subjects a strip of low carbon rimmed steel to a cold rolling finish with a rolling reduction of at least 40% to provide a strip material of not more than 0.2 mm in thickness, which is delivered in the form of coil to an etching processer. At the etching processer, the strip material is pretreated to remove oil while being unwound from the coil. Predetermined patterns of holes are then formed in the strip material by application of a photoresist on both sides of the strip, patternwise exposure of the photoresist, developing of the exposed photoresist, hardening of the developed photoresist by burning it at a temperature of about 200° C., etching of the material through the hardened patterned photoresist by spraying an aqueous ferric chloride, and removal of the photoresist. The product is cut into individual flat masks and delivered to a Braun tube maker. At the Braun tube maker, the flat mask having a predetermined pattern of holes is annealed to impart it a sufficient ductility for the subsequent press-forming. This annealing is normally effected at a high temperature ranging between 750° and 900° C. with the individual masks suspended or stacked. Since the steel strip as annealed has a yield point elongation of several percent, "stretcher strains"(Lüders lines) arise when it is press-formed. Furthermore, the flat mask loses its evenness owing to the annealing. In order to erase the unevenness of the annealded strip and to prevent the stretcher strains, the annealed flat mask is several times passed through a roller leveller and thereafter press-formed into the desired curved plane. After the formation of oxide films on the surfaces, the shadow mask to manufactured is mounted in a Braun tube.

The prior art process stated above, in which the annealing step is carried out after the formation of holes, will be referred to as a post-anneal process. The post-anneal process poses several problems, especially regarding the annealing step carried out by a Braun tube maker.

Since the flat masks are annealed in the state of being suspended or stacked, the efficiency is low and the cost is expensive. The annealing temperature as high as 750° to 900° C. frequently results in the adhesion of flat masks, leading to the reduction in the yield. Even with successfully annealed flat masks, waves are formed by the annealing at high temperatures and the subsequent leveller rolling to erase such waves involves a danger in that the pattern of holes may be distorted or wrinkles may arise. Furthermore, the high temperature anneal causes the carbon in the low carbon steel material to diffuse and precipitate in the form of carbides near the surfaces of the strip, and this precipitation of carbides is not necessarily uniform. Any non-uniformity of the carbides precipitation results in non-uniform elongation of the material in the press-forming step, and thus, fault products are frequently found after the press-forming step.

To overcome the problems discussed above, attempts have been made to use lower annealing temperatures. However, when a sufficiently low annealing temperature for avoiding the adhesion and thermal distortion of flat masks was used, the grains became finer, resulting in an increase in the yield point elongation of the annealed material, and it was necessary to impractically increase the number of passes through a roller leveller for preventing stretcher strains.

For the purpose of avoiding the above-discussed problems inherent to the post-anneal process, processes, in which the annealing step is carried out before the hole formation, have been proposed. Such a process, in which the annealing step is carried out by a steel maker before the formation of holes, will be referred to a pre-anneal process.

Japanese Patent Laid-Open Application No. 49-110,562, published on Oct. 21, 1974, discloses a process for producing a low carbon cold rolled steel strip for a shadow mask of a color Braun tube comprising cold rolling a hot rolled sheet of a low carbon and low manganese steel with a rolling reduction of at least 30%, annealing the cold rolled strip at a temperature of 650° to 750° C. and rolling the annealed strip for conditioning with a rolling reduction of 0.5 to 5.0%.

Japanese Patent Laid-Open Application No. 50-23317, published on Mar. 13, 1975, Japanese Patent Examined Publication No. 52-44868, and the corresponding U.S. Pat. No. 3,909,928 issued on Oct. 7, 1975, disclose a method for manufacturing a shadow mask comprising annealing a low carbon sheet steel at a temperature of 550° to 650° C., subjecting the annealed sheet steel to skin-pass rolling for a reduction of 0.5 to 15% in thickness, forming holes in the sheet steel, and press-forming the sheet steel into a desired plane.

The previously discussed problems inherent to the post-anneal process have been solved by the prior art pre-anneal process. We have found, however, that in the practice of the prior art pre-anneal process, the etching processer is normally encountered by a difficulty in that the annealed steel strip material delivered from the steel maker is too soft to be suitably processed by the etching processer. A rimmed steel strip as subjected to a cold rolling finish may has a Vickers hardness of at least 170. But when annealed, the material has a Vickers hardness of substantially less than 110. Such a soft and thin material is extremely difficult to be suitably processed.

SUMMARY OF THE INVENTION

An object of the invention is to provide an improved pre-anneal process for manufacturing a shadow mask of a Braun tube for a color TV in which the annealing step is carried out by a steel maker prior to the formation of holes and the annealed material has a sufficient hardness for the subsequent processing.

This object can be achieved in accordance with the invention by utilizing a special steel alloy.

Thus, in accordance with one aspect of the invention there is provided a shadow mask of a Braun tube for a color TV which is made of a strip of low carbon steel falling within the following composition limits in weight percent: $C \leqq 0.12$, $0.2 \leqq Mn \leqq 1.5$, $0.3 \leqq Si \leqq 1.5$, $1.0 \leqq 2Si + Mn$, $0.005 \leqq Al \leqq 0.030$, and the balance being Fe and impurities unavoidably coming into said steel during the course of the production thereof.

In accordance with another aspect of the invention there is provided a process for manufacturing a shadow mask of a Braun tube for a color TV comprising the steps of subjecting a strip of a steel alloy to a cold rolling finish to provide a steel alloy strip material of not more than 0.2 mm in thickness, said steel alloy falling within the following composition limits in weight percent: $C \leqq 0.12$, $0.2 \leqq Mn \leqq 1.5$, $0.3 \leqq Si \leqq 1.5$, $1.0 \leqq 2Si + Mn$, $0.005 \leqq Al \leqq 0.030$, and the balance being Fe and impurities unadvoidably coming into said steel alloy in the course of the production thereof, annealing the so-rolled strip material, the annealed strip material having a Vickers hardness of at least 110, forming predetermined patterns of holes in the annealed strip material by a photoetching technique, cutting the material into individual flat masks of a pre-determined dimension, and pressforming the flat mark into a desired shape.

DETAILED DESCRIPTION OF THE INVENTION

Figure 1:
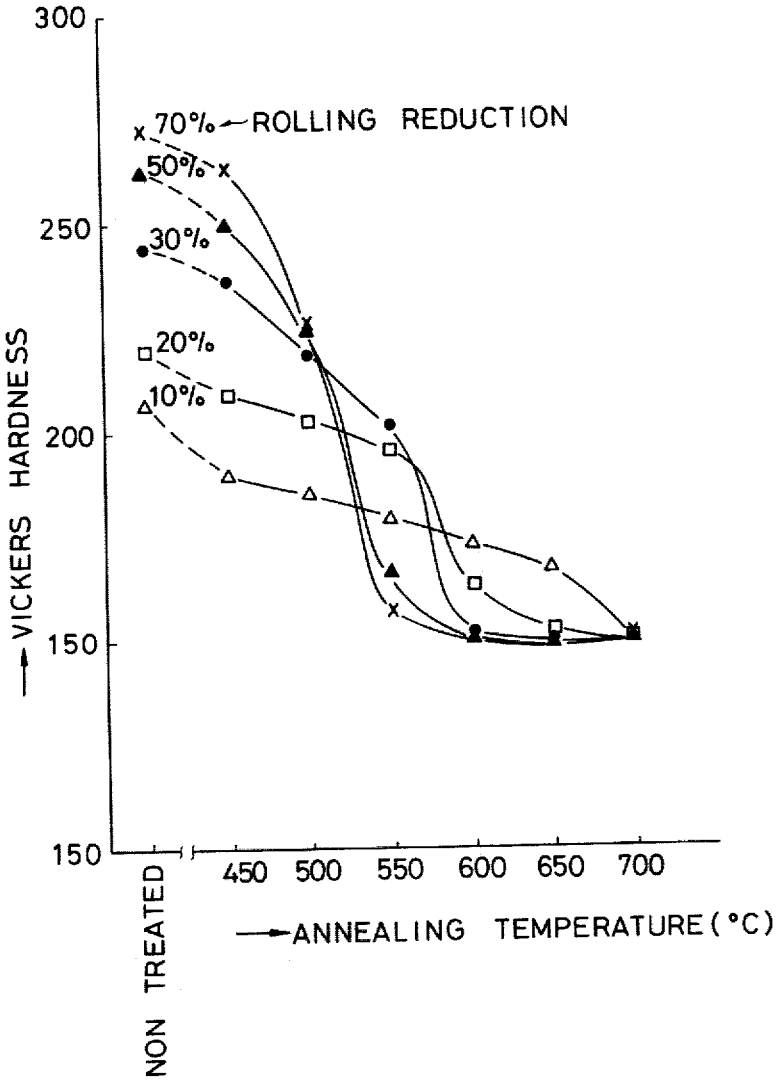
FIG. 1 graphically represents the dependency of the Vickers hardness upon the annealing temperature on samples which have been subjected to cold rolling finishes with various rolling reductions.

The invention is based on the discovery that if a special steel alloy is used in a pre-anneal process for the manufacture of a shadow mask of a Braun tube for a color TV, the annealed strip material can be hard and ductile so that it may be easily and suitably processed not only in the hole formation step but also in the press forming step.

The carbon content of the steel alloy, which is used in the manufacture of a shadow mask in accordance with the invention, should be controlled at a level not higher than 0.12% by weight. The presence of an excessive amount of carbon adversely affects not only the press-formability of the flat mask but also the hole-forming performance of the annealed strip due to the formation of carbides. We have also found that a desirable electromagnetic property of the product is also adversely affected by an excessive amount of carbon. The carbon content of the steel alloy may be reduced, for example, by carrying out a vacuum decarburization in the steel making process, or by carrying out an open coil decarburization anneal in the rolling process.

Manganese is an element, which dissolves in the steel and increases the strength thereof. For this purpose and also for preventing the red shortness at the time of being hot worked, we have found that at least 0.1%, preferably at least 0.2% by weight of Mn in the steel alloy is essential. However, the presence of an excessive amount of Mn not only renders the steel harder than necessary, leading to the impairment of the press-formability of the flat mask, but also makes the production of the steel difficult owing to the formation of bands of ferrite and pearlite. We have found that the manganese content of up to 1.5% by weight is permissible.

Silicon is an element, which also dissolves in the steel and effectively increases the strength of the steel. This element also serves as a deoxidizer in the steel making process. For these reasons we use at least 0.3% by weight of Si. However, the presence of an excessive amount of Si renders the steel harder than necessary, and makes both the production of strip and the production shadow mask difficult. We have found that the silicon content of the steel alloy should not exceed 1.5% by weight.

The annealed strip material must have a Vickers hardness of at least 110, or otherwise it cannot be easily and properly processed in the subsequent hole-forming step. We have found that in order to retain such a level of hardness, Si, the silicon content of the steel alloy, and Mn, the manganese content of the steel alloy, should further satisfy the relation: $1 \leqq 2Si + Mn$.

Aluminum is an element which serves to stabilize nitrogen in the steel by forming aluminum nitride, thereby to control the aging effect due to nitrogen, and in turn control stretcher strains arising in the press-forming step. For such functions, at least 0.005% by weight of Al is required. However, the presence of an excessive amount of Al adversely affects the shapes and configurations of holes formed by a photo-etching process. Generally, up to 0.030% by weight of Al has been found suitable. The aluminum and silicon may be conveniently incorporated into the steel by carrying out the deoxidation of the steel using these elements as a deoxidizer.

From the steel alloy proposed herein a shadow mask in accordance with the invention may be prepared as follows. A hot rolled sheet is prepared from the molten steel alloy. It is subjected to at least one combination of a cold rolling and an intermediate anneal, and then to a final cold rolling finish to provide a strip of a desired thickness of not more than 0.2 mm. The rolling reduction used in the finish rolling may vary, for example, within the range from 20 to 80%. The cold rolled strip is then subjected to a recrystallization anneal. The temperature at which the cold rolled strip is annealed may vary within the range between 520° C. and 650° C., preferably between 580° and 620° C. The strip may be subjected to a cold rolling finish with a rolling reduction of at least 30%, and then annealed in the form of a tight coil at a temperature of not higher than 620° C. for a period of at least 2 hours. FIG. 1 is a graphical representation of the dependency of the hardness of the annealed strip material upon the finish rolling reduction and the annealing temperature on samples from Steel C as indicated in Table 1. In the experiments, on which FIG. 1 is based, strip samples prepared from Steel C, which had been subjected to cold rolling finishes with various rolling reductions as indicated in FIG. 1, were annealed at various temperatures for 3 hours and then tested for the Vickers hardness. FIG. 1 reveals that the Vickers hardness of the annealed strip made from the steel alloy in accordance with the invention is well above 110, although it depends upon the processing conditions, such as the rolling reduction in the cold rolling finish and the annealing temperature. The annealed strip material may be subjected to a rolling for conditioning and then delivered to an etching processer.

At the etching processer, predetermined patterns of holes are formed in the strip material by a conventional photo-etching technique. The annealed strip material prepared in accordance with the invention exhibits an excellent hole-forming performance. In other words, the material is sufficiently hard although it has been annealed, and thus can be easily processed in the hole-forming step with minimum tendency to evil deformation. Furthermore, shapes and configurations of the holes formed are satisfactory. The strip material, in which holes have been formed, is then cut into individual flat masks, which are delivered to a Braun tube maker.

At the Braun tube maker the flat mask may be directly, or after being properly levelled, press-formed into a desired shape.

The invention will be further described by the following Example.

EXAMPLE

The compositions of the steel samples tested are indicated in Table 1.

TABLE 1

| | Reference letter | C | Si | Mn | P | S | Al |
|---|---|---|---|---|---|---|---|
| According | A | 0.06 | 0.42 | 0.31 | 0.015 | 0.016 | 0.027 |
| to | B | 0.08 | 0.71 | 0.59 | 0.012 | 0.014 | 0.019 |
| the | C | 0.11 | 0.99 | 0.80 | 0.011 | 0.008 | 0.013 |
| invention | D | 0.05 | 0.40 | 1.41 | 0.012 | 0.013 | 0.016 |
| | E | 0.06 | 1.42 | 0.29 | 0.013 | 0.014 | 0.014 |
| | F | 0.10 | 1.10 | 0.76 | 0.009 | 0.012 | 0.013 |
| | G | 0.006 | 0.82 | 0.69 | 0.014 | 0.013 | 0.009 |
| Control | H | 0.08 | 0.01 | 0.27 | 0.018 | 0.012 | 0.037 |
| | I | 0.06 | 0.01 | 0.28 | 0.016 | 0.011 | 0.003 |
| | J | 0.08 | 0.01 | 0.30 | 0.016 | 0.014 | 0.002 |

Steel A to G are those according to the invention, of these steels, Steels A to F were prepared by refining in a converter, whereas Steel G was prepared by refining in a converter followed by vacuum decarburization. Steels H,I and J are Controls outside the scope of the invention.

From each steel samples a hot rolled sheet having a thickness of 2.0 mm was prepared. The sheet was then subjected to a cold rolling, an intermediate anneal and then a final cold rolling finish to provide a strip of 0.15 mm in thickness. The final cold rolling finish was carried with a rolling reduction of 50%. The rolled strip was then subjected to a recrystallization anneal in the form of a tight coil at a temperature of 580° C. for a period of 8 hours. The annealed strip was then rolled for conditioning. The strips so processed had the grain size number of 8 to 11 as measured by the Method for Estimating Ferrits Grain Size of Steels in accordance with JIS G0552. With respect to Steels F and I, the intermediate anneal was replaced by an open coil decarburization anneal, whereby the carbon content of these steels was reduced to 0.002%. Mechanical properties of the annealed strips are shown in Table 2.

Using each annealed strip, a shadow mask was prepared by the conventional manner. The hole-forming performance of the strip and the press-formability of the flat mask were evaluated, and the results are also shown in Table 2.

TABLE 2

| | Reference letter | Tensile strength (Kg/mm$^2$) | (%) | Vickers hardness | Hole-forming performance: Occurrence of evil deformation | Hole-forming performance: Shapes of holes | Press-formability |
|---|---|---|---|---|---|---|---|
| According | A | 39.8 | 37.9 | 123 | no | good | good |
| to | B | 44.2 | 33.8 | 137 | no | good | good |
| the | C | 51.4 | 30.1 | 157 | no | good | good |
| invention | D | 46.3 | 31.0 | 139 | no | good | good |
| | E | 48.9 | 29.3 | 147 | no | good | good |
| | F | 46.9 | 34.1 | 140 | no | good | good |
| | G | 44.5 | 35.6 | 129 | no | good | good |
| Control | H | 35.8 | 41.3 | 103 | yes | poor | good |
| | I | 30.2 | 46.1 | 92 | yes | good | good |
| | J | 33.4 | 40.1 | 96 | yes | good | good |

It is revealed from the results shown in Table 2 that the annealed strips prepared from the steels in accordance with the invention have good mechanical properties so that they exhibit satisfactory processing performance both in the hole-formation step and in the press-forming step. Whereas the annealed strips prepared from the tested control steels have a Vickers hardness of substantially less than 110, thereby exhibiting poor processing performance in the hole-formation step. It should be noted that all the annealed strips were prepared under the same manufacturing conditions.

A flat mask sample prepared from Steel B was levelled, allowed to stand for 30 days and then press-formed. Occurrence of stretcher stains was not observed. Whereas when a flat mask sample prepared from Steel J, which had been levelled and allowed to stand for 3 days, was press-formed, occurrence of substantial stretcher strains was observed.

What is claimed is:

1. A shadow mask of a Braun tube for a color TV made of a strip of low carbon steel, characterized in that said low carbon steel falls within the following composition limits in weight percent: $C \leqq 0.12$, $0.2 < Mn < 1.5$, $0.3 \leqq Si \leqq 1.5$, $1.0 \leqq 2Si + Mn$, $0.005 \leqq Al \leqq 0.030$, and the balance being Fe and impurities unavoidably coming into said steel during the course of the production thereof.

2. A shadow mask in accordance with claim 1 having a thickness of not more than 0.2 mm and a Vickers hardness of at least 110.

3. A shadow mask in accordance with claim 2 having a Vickers hardness of at least 120.

4. A process for manufacturing a shadow mask of a Braun tube for a color TV comprising the steps of subjecting a strip of low carbon steel to a cold rolling finish to provide a steel strip material of not more than 0.2 mm in thickness, annealing the so-rolled material, forming predetermined patterns of holes in the annealed strip material by a photoetching technique, cutting the material into individual flat masks of a predetermined dimension, and pressforming the flat mask into a desired shape, characterized in that said low carbon steel falls within the following composition limits in weight percent: $C \leqq 0.12$, $0.2 \leqq Mn \leqq 1.5$, $0.3 \leqq Si \leqq 1.5$, $1.0 \leqq 2Si + Mn$, $0.005 \leqq Al \leqq 0.030$, and the balance being Fe and impurities unavoidably coming into said steel during the course of the production thereof, and that said annealed strip material has a Vickers hardness of at least 110.

5. A process in accordance with claim 4 wherein said annealed strip material has a Vickers hardness of at least 120.

6. A process in accordance with claim 4 or 5, wherein said strip of low carbon steel is subjected to a cold rolling finish with a rolling reduction of 20 to 80% and the so-rolled strip material is annealed at a temperature of 520° C. to 650° C.

7. A process in accordance with claim 6 wherein said strip of low carbon steel is subjected to a cold rolling finish with a rolling reduction of at least 30% and the so-rolled strip material is annealed in the form of a tight coil at a temperature of not more than 620° C.

* * * * *